US012157202B2

(12) United States Patent
Chen et al.

(10) Patent No.: US 12,157,202 B2
(45) Date of Patent: Dec. 3, 2024

(54) POLISHING MACHINE WITH AUTOMATIC FEED AND DISCHARGE FUNCTION

(71) Applicant: HUNAN YUHUAN INTELLIGENT EQUIPMENT CO., LTD., Hunan (CN)

(72) Inventors: Kaiyin Chen, Hunan (CN); Bo Zhou, Hunan (CN); Shaobin Wu, Hunan (CN); Shadong Wen, Hunan (CN)

(73) Assignee: HUNAN YUHUAN INTELLIGENT EQUIPMENT CO., LTD., Hunan (CN)

( * ) Notice: Subject to any disclaimer, the term of this patent is extended or adjusted under 35 U.S.C. 154(b) by 373 days.

(21) Appl. No.: 17/768,861

(22) PCT Filed: Mar. 19, 2021

(86) PCT No.: PCT/CN2021/081689
§ 371 (c)(1),
(2) Date: Apr. 14, 2022

(87) PCT Pub. No.: WO2021/238358
PCT Pub. Date: Dec. 2, 2021

(65) Prior Publication Data

US 2023/0271297 A1 Aug. 31, 2023

(30) Foreign Application Priority Data

May 28, 2020 (CN) ..... 202010470813.2

(51) Int. Cl.
*B24B 29/00* (2006.01)
*B24B 27/00* (2006.01)
(Continued)

(52) U.S. Cl.
CPC ..... *B24B 29/00* (2013.01); *B24B 27/0061* (2013.01); *B24B 27/0076* (2013.01);
(Continued)

(58) Field of Classification Search
CPC ..... B24B 41/002; B24B 41/02; B24B 41/047; B24B 41/053; B24B 41/068; B24B 41/005; B24B 29/00; B24B 27/0076
See application file for complete search history.

(56) References Cited

U.S. PATENT DOCUMENTS 4,712,289 A * 12/1987 Stamm ..... B24D 9/085 483/33
5,231,803 A * 8/1993 Lanzer ..... B24D 9/085 451/28
6,264,534 B1 * 7/2001 Panyard ..... B24B 49/16 451/24
8,915,767 B2 * 12/2014 Shen ..... B24D 9/085 451/458
(Continued)

FOREIGN PATENT DOCUMENTS

CN 204673250 9/2015
CN 105922116 9/2016
(Continued)

OTHER PUBLICATIONS

"International Search Report (Form PCT/ISA/210) of PCT/CN2021/081689," mailed on Jun. 21, 2021, with English translation thereof, pp. 1-4.

*Primary Examiner* — Joel D Crandall
(74) *Attorney, Agent, or Firm* — JCIPRNET

(57) ABSTRACT

A polishing machine with an automatic feed and discharge function includes a machine frame, a clamping mechanism, a polishing shaft, a feed mechanism and a discharge mechanism. The clamping mechanism, the discharge mechanism, the polishing shaft and the feed mechanism are mounted on the machine frame. Multiple polishing heads are mounted on the polishing shaft. The feed mechanism includes a feed frame, a sliding platform, a sliding drive member, multiple columns of storage mechanisms for storing polishing pads,
(Continued)

and multiple columns of push mechanisms, and the number of the columns of the storage mechanisms matches the number of the columns of the push mechanisms. The feed frame is mounted on the machine frame. The sliding platform is slidably arranged on the feed frame. The storage mechanisms are mounted on the sliding platform. The push mechanisms are mounted on the feed frame and are located above the storage mechanisms.

17 Claims, 15 Drawing Sheets

(51) Int. Cl.
*B24B 41/00* (2006.01)
*B24B 41/02* (2006.01)
*B24B 41/06* (2012.01)

(52) U.S. Cl.
CPC ..... *B24B 41/005* (2013.01); *B24B 41/02* (2013.01); *B24B 41/06* (2013.01)

(56) References Cited

U.S. PATENT DOCUMENTS

| | | | | |
|---|---|---|---|---|
| 2015/0044948 | A1* | 2/2015 | Kottbus | B25J 11/0065 451/442 |
| 2015/0328734 | A1* | 11/2015 | Multhammer | B23Q 3/15706 483/33 |
| 2016/0039067 | A1* | 2/2016 | Bonnet | B24B 23/046 451/259 |
| 2019/0152015 | A1* | 5/2019 | Naderer | B24B 27/0038 |

FOREIGN PATENT DOCUMENTS

| | | | | |
|---|---|---|---|---|
| CN | 205552200 | | 9/2016 | |
| CN | 111571409 | | 8/2020 | |
| JP | H02269549 | | 11/1990 | |
| KR | 20160148431 | A * | 12/2016 | B24B 41/06 |

* cited by examiner

POLISHING MACHINE WITH AUTOMATIC FEED AND DISCHARGE FUNCTION

CROSS-REFERENCE TO RELATED APPLICATION

This application is a 371 of international application of PCT application serial no. PCT/CN2021/081689, filed on Mar. 19, 2021, which claims the priority benefit of China application no. 202010470813.2, filed on May 28, 2020. The entirety of each of the above mentioned patent applications is hereby incorporated by reference herein and made a part of this specification.

TECHNICAL FIELD

The invention mainly relates to the technical field of a polishing machine, in particular to a polishing machine with automatic feed and discharge function.

DESCRIPTION OF RELATED ART

The modern manufacturing industry puts forward more and more requirements for CNC equipment to ensure that the equipment can fulfill high-speed, high-efficiency and high-precision machining of complex parts. Five-axis machining tools are more and more widely applied to modern equipment for machining complex parts and greatly improve the industrial manufacturing level and efficiency due to their advantages of high precision, flexible programming, capacity to machine various complex curved surfaces, and capacity to machine five surfaces by one time of clamping.

In the prior art, a five-axis or multi-axis polishing machine comprises a polishing mechanism provided with multiple polishing heads, and polishing pads are loaded on the polishing heads and are generally bonded to the polishing heads. The polishing pads, as consumables, need to be replaced frequently to guarantee the polishing efficiency and quality. According to existing methods, the polishing pads are bonded to the polishing heads one by one manually, which not only consumes too much time and labor and seriously restrains the production capacity; in addition, the polishing pads often fail to be discharged from the polishing heads or be loaded onto the polishing heads, which results in great trouble and uncertainties to subsequent polishing.

BRIEF SUMMARY OF THE INVENTION

The technical issue to be settled by the invention is to overcome the defects of the prior art by providing a polishing machine with an automatic feed and discharge function, which is simple in structure, capable of saving time and labor, capable of guaranteeing the pad loading and discharging accuracy, and capable of improving the production capacity and efficiency.

To settle the above technical issue, the invention adopts the following technical solution:

A polishing machine with an automatic feeding and discharging function includes a machine frame, a clamping mechanism, a polishing shaft, a feed mechanism and a discharge mechanism, wherein the clamping mechanism, the discharge mechanism, the polishing shaft and the feed mechanism are mounted on the machine frame from bottom to top; multiple polishing heads are mounted on the polishing shaft in a circumferential direction and an axial direction; and the feed mechanism includes a feed frame, a sliding platform, a sliding drive member, multiple columns of storage mechanisms for storing polishing pads, and multiple columns of push mechanisms, the number of the columns of the storage mechanisms matches the number of the columns of the push mechanisms, the feed frame is mounted on the machine frame, the sliding platform is slidably arranged on the feed frame, the multiple columns of storage mechanisms are mounted on the sliding platform, the multiple columns of push mechanisms are mounted on the feed frame and are located above the storage mechanisms, the sliding drive member is mounted on the sliding platform and drives the sliding platform to drive the storage mechanisms to correspond to the polishing heads below and the push mechanisms above in position, and the push mechanisms push the polishing pads in the storage mechanisms to the polishing heads to be bonded onto the polishing heads.

As a further improvement of the above technical solution:

each storage mechanism includes a mounting frame and multiple storage cylinders for storing the polishing pads, wherein each column of storage cylinders are fixedly arranged on the mounting frame in multiple rows, and the mounting frame is mounted on the sliding platform.

The storage cylinders are hollow vertically, and an elastic clip is disposed on an inner edge of the bottom of each storage cylinder.

Openings for placing the polishing pads into the storage cylinders are formed in sides, away from the mounting frame, of the storage cylinders.

The mounting frame includes a fixing plate and insertion lugs, the sliding platform is provided with insertion poles, the storage cylinders in each column are fixedly arranged on the fixing plate, the insertion lugs are fixedly arranged on the fixing plate, and the insertion poles are inserted into the insertion lugs.

Lock bolts are disposed on lateral portions of the insertion lugs, slots are formed in the insertion poles, and the lock bolts are matched with the slots for locking.

The sliding platform is provided with feed sensors for detecting whether polishing pads exist on the polishing heads, the sliding platform is also provided with spring bolts, and when the spring bolts are lifted by polishing pads on the polishing heads, the feed sensors sense the spring bolts.

The feed frame includes a fixing frame, a turnable frame and turning drive members, wherein the fixing frame is mounted on the machine frame, the turning drive members are hinged to the fixing frame, the turnable frame is hinged to the turning drive members, the sliding platform is slidably arranged on the turnable frame, and the push mechanisms are mounted on the fixing frame.

The fixing frame is slidably arranged on the machine frame, a lifting motor connected to the fixing frame is mounted on the machine frame, and when the lifting motor drives the fixing frame to a low position, gaps between the storage mechanisms and the polishing heads are equal to the thickness of one polishing pad.

The turnable frame is provided with limit sensors located at two ends and an origin sensor located between the limit sensors, in a travel direction of the sliding platform.

Each push mechanism includes a push cylinder fixedly arranged on the feed frame and a push head connected to the push cylinder.

The discharge mechanism includes a discharge frame, a movable frame, a moving drive member and multiple columns of grabbing mechanisms for grabbing polishing pads on the polishing heads, wherein the discharge frame is mounted on the machine frame, the movable frame is slidably arranged on the discharge frame, the multiple columns of grabbing mechanisms are mounted on the movable frame, and the moving drive member is mounted on the discharge frame and drives the movable frame to drive the grabbing mechanisms to move to positions corresponding to the corresponding polishing heads.

Each grabbing mechanism includes a pneumatic seat, a pair of sliding seats and clamping jaws mounted on the sliding seats, wherein the pneumatic seat is fixedly arranged on the movable frame and is connected to an external gas, the pair of sliding seats is slidably arranged on the pneumatic seat and drives the clamping jaws to clamp and grab the polishing pads on the polishing heads.

A shield for covering the movable frame, the moving drive member and the grabbing mechanisms is disposed on the discharge frame.

The shield is formed with recess holes allowing the clamping jaws to stretch out.

Water baffles for sealing the recess holes are mounted on the shield, and the clamping jaws penetrate through the water baffles.

Stoppers for driving the polishing pads to fall off from the clamping jaws are also mounted on the shield.

Slideways are disposed on the discharge frame, and the movable frames are slidably arranged on the slideways.

Compared with the prior art, the invention has the following advantages:

When the polishing machine with an automatic feed and discharge function is used, polishing pads are placed in the storage mechanisms first; when polishing pads on the polishing heads need to be replaced, the polishing machine is stopped, and the discharge mechanism is started to grab the polishing pads on the polishing heads, so that automatic discharge of the polishing pads is realized; then, the sliding drive member is started to drive the sliding platform to drive the storage mechanisms to correspond to the polishing heads below and the push mechanisms above in position, then the push mechanisms are started to push the polishing pads in the storage mechanisms to the polishing heads to be bonded onto the polishing heads, so that automatic feed of the polishing pads is completed; and parts are clamped on the clamping mechanism and are then polished by the polishing heads on the polishing shaft. Compared with traditional structures, the polishing machine can load and discharge polishing pads automatically through the feed mechanism and the discharge mechanism, has a simple structure, saves time and labor, and improves the production capacity and efficiency; in addition, failures to load or discharge polishing pads caused by manual operation are avoided, and the pad loading and discharging accuracy is guaranteed.

DETAILED DESCRIPTION OF THE INVENTION

The invention will be described in further detail below in conjunction with the accompanying drawings and specific embodiments in the specification.

Figure 1:
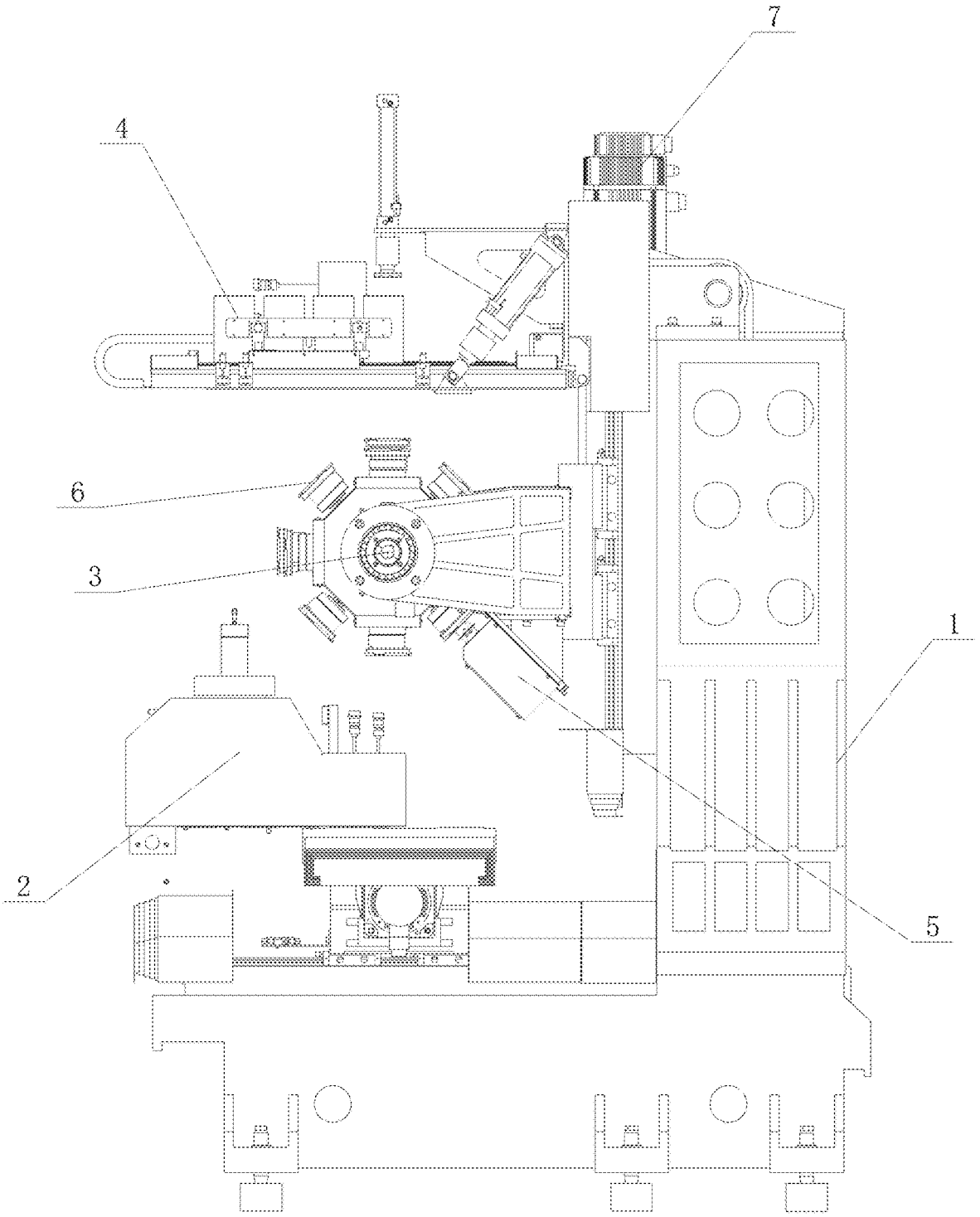
FIG. 1 is a front structural view of the invention.
Figure 2:
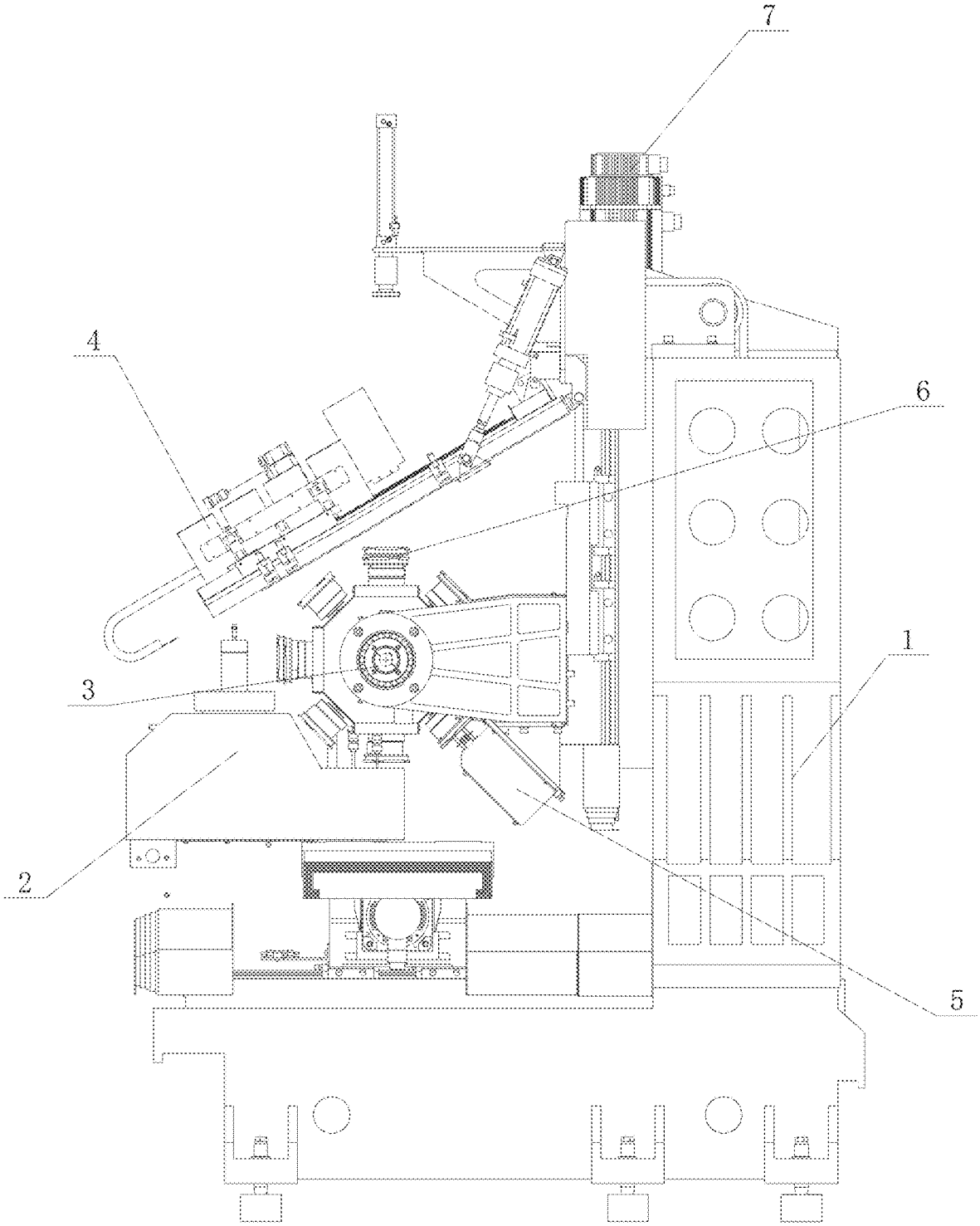
FIG. 2 is a front structural view of the invention (a feed mechanism is turned).
Figure 3:
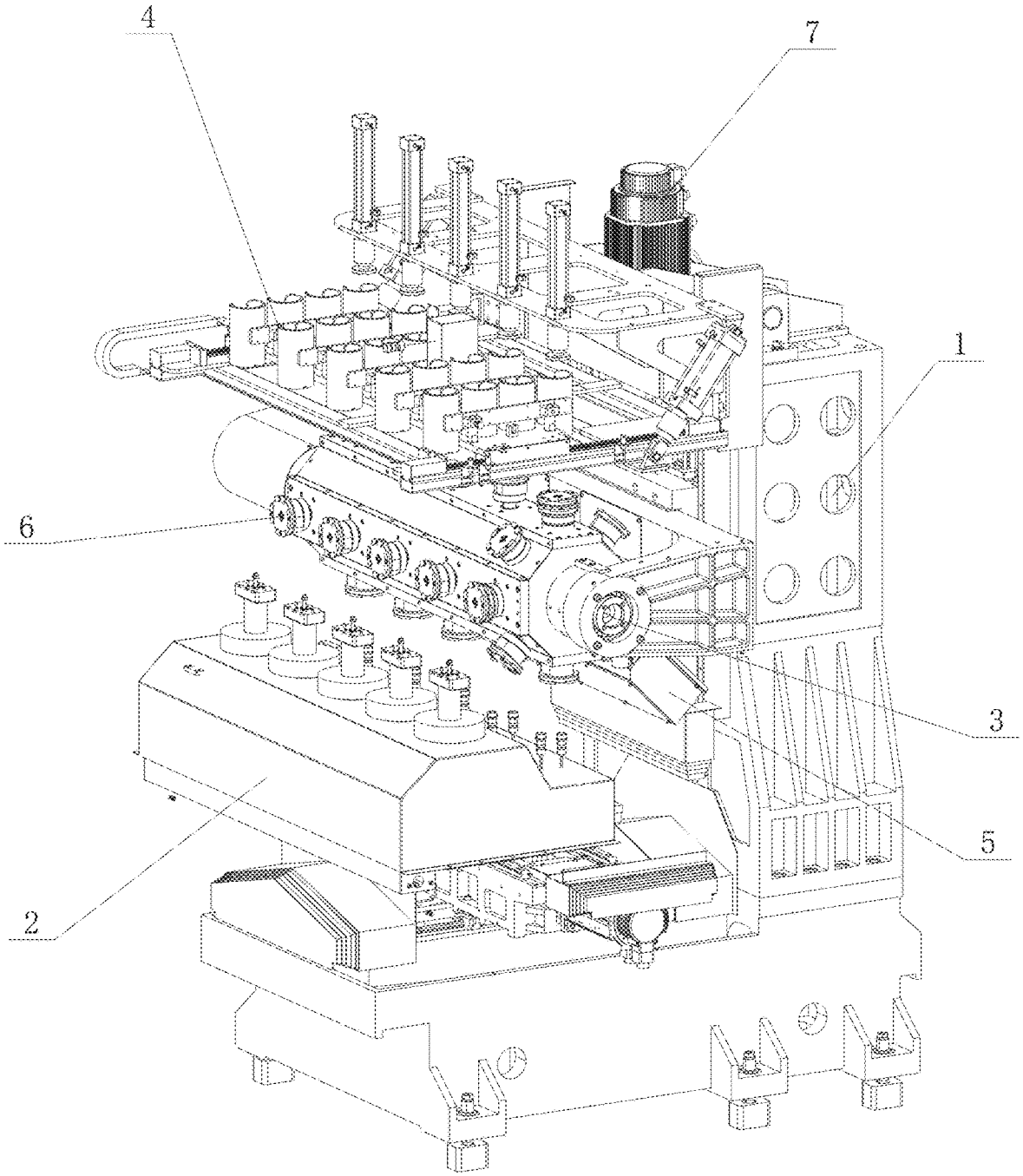
FIG. 3 is a three-dimensional structural view of the invention.
Figure 4:
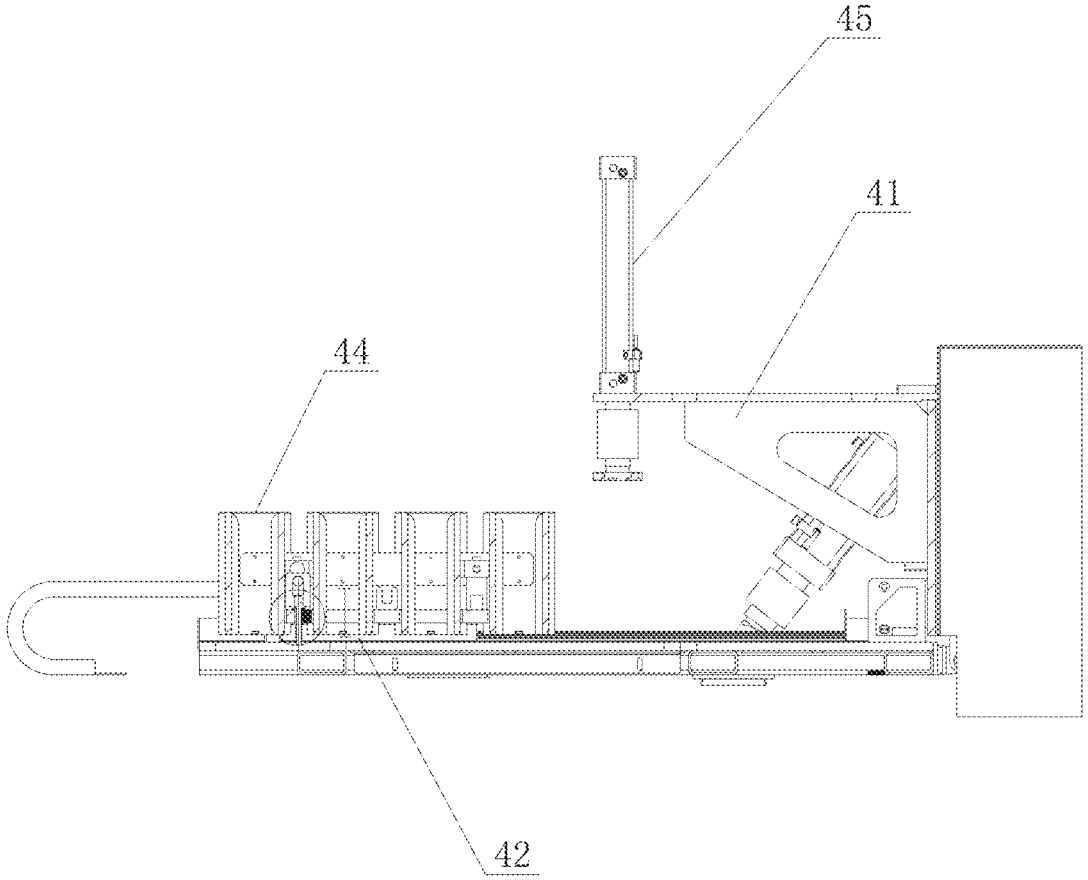
FIG. 4 is a front structural view of a feed mechanism of the invention.
Figure 5:
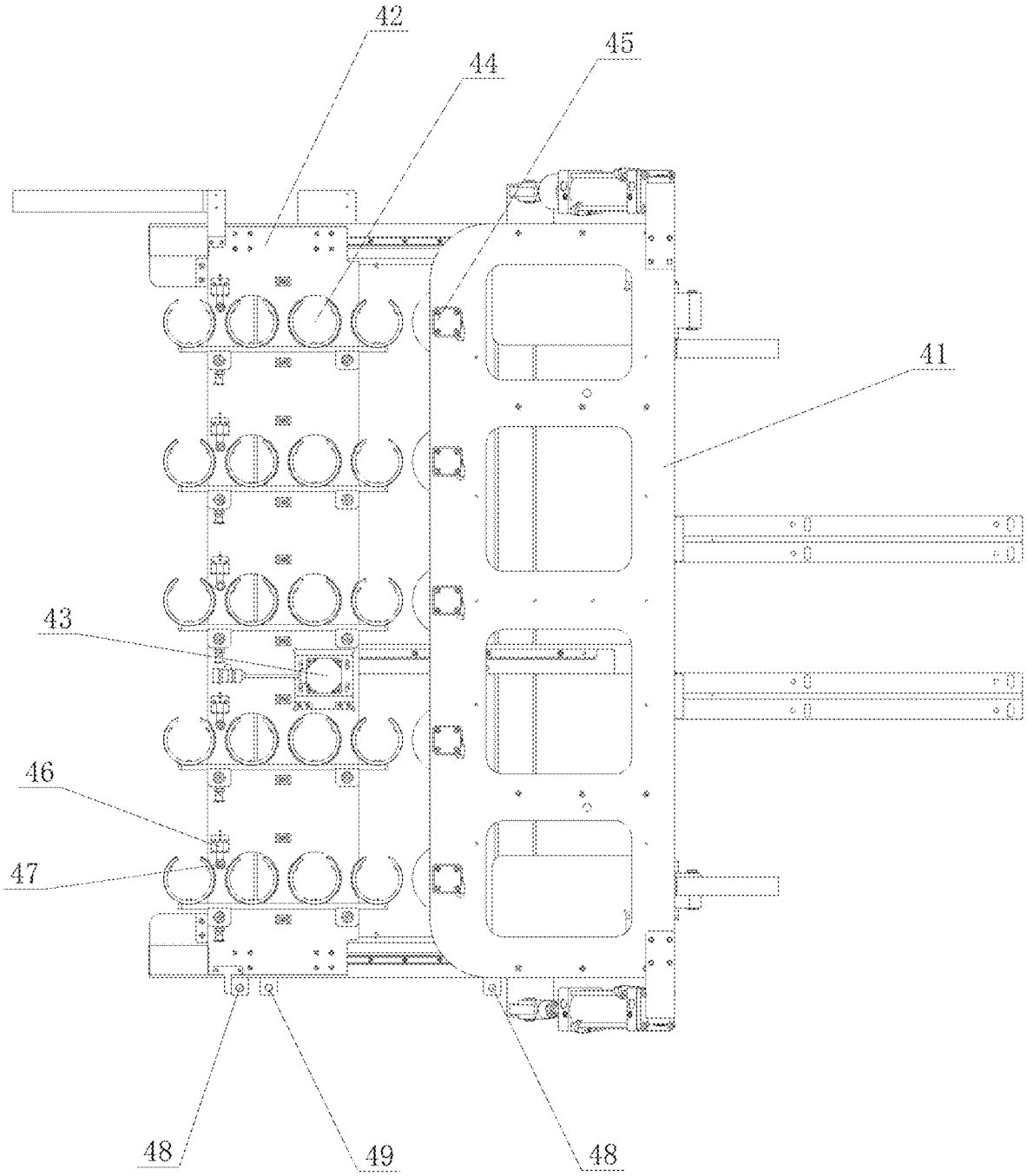
FIG. 5 is a top view of the feed mechanism of the invention.
Figure 6:
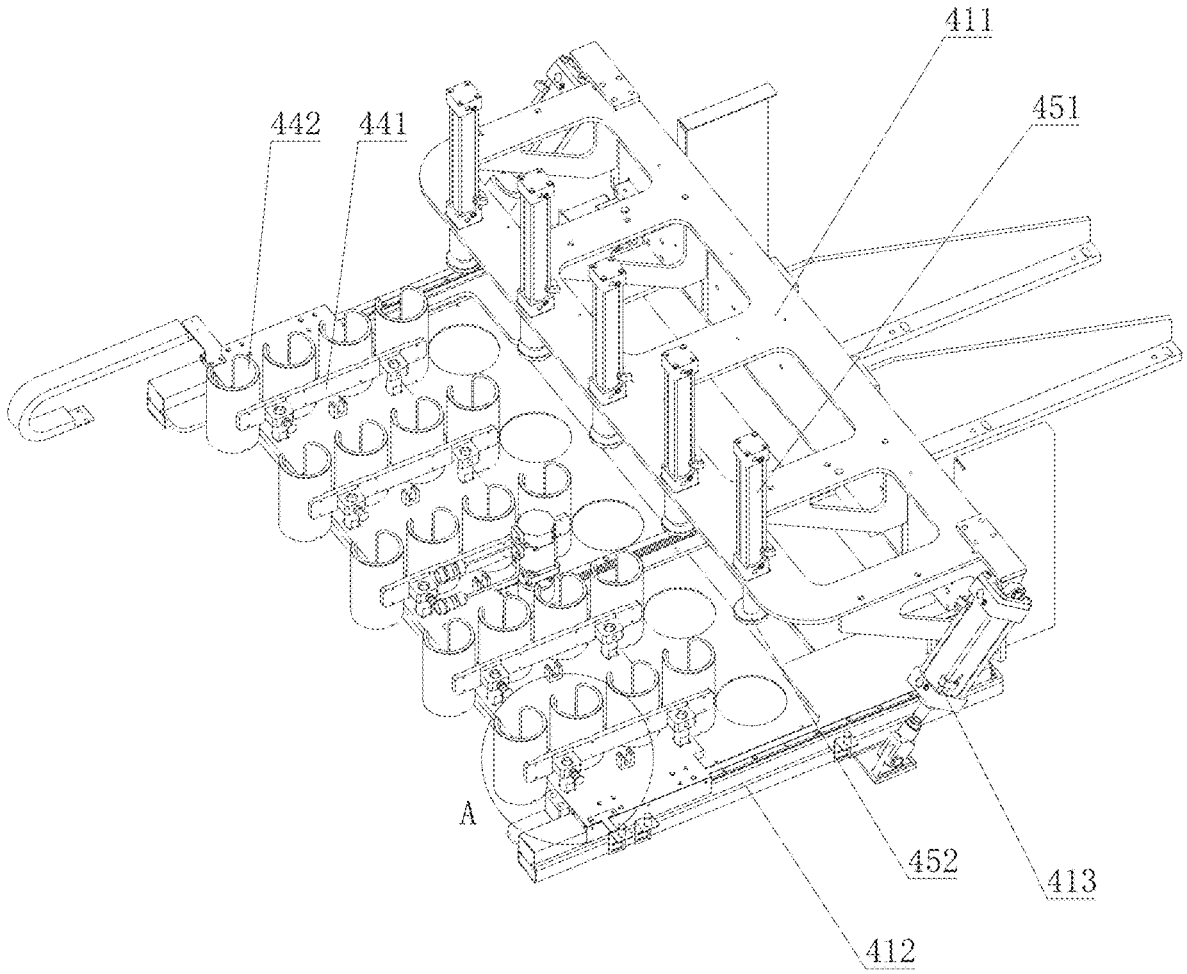
FIG. 6 is a three-dimensional structural view of the feed mechanism of the invention.
Figure 7:
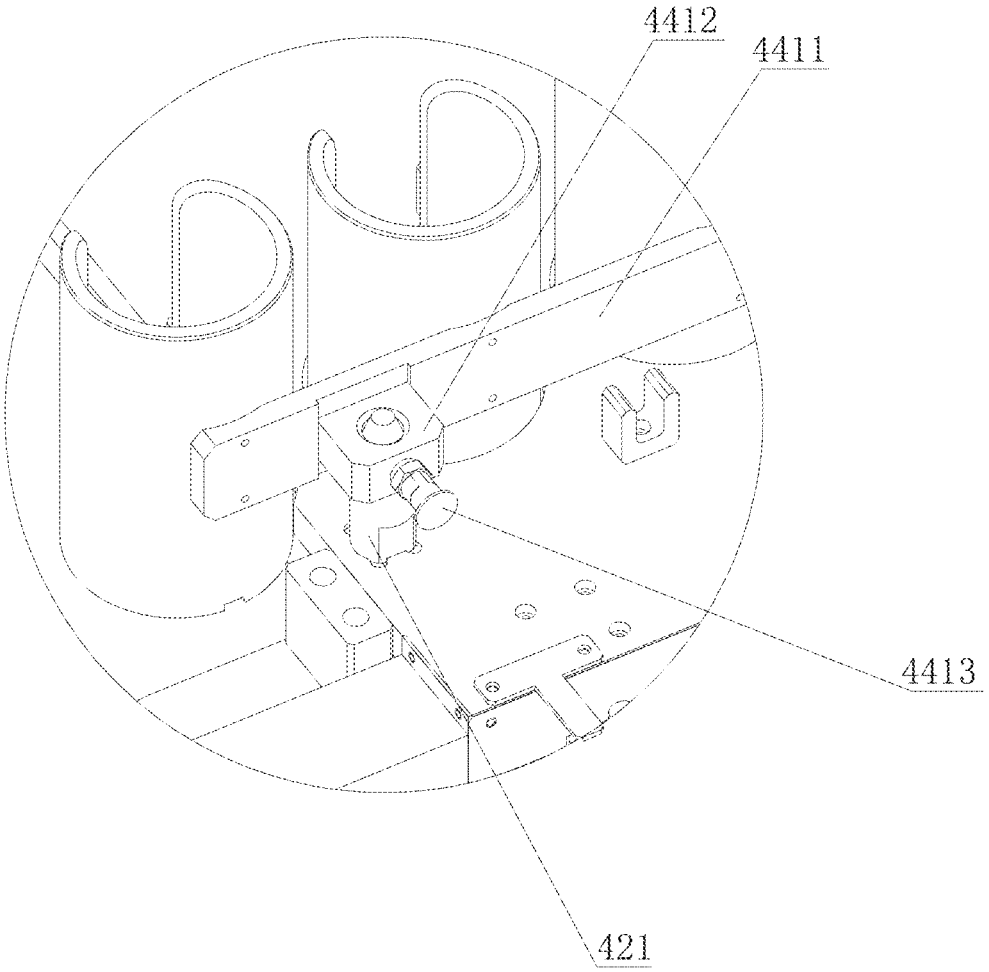
FIG. 7 is an enlarged structural view of part A in FIG. 6.
Figure 8:
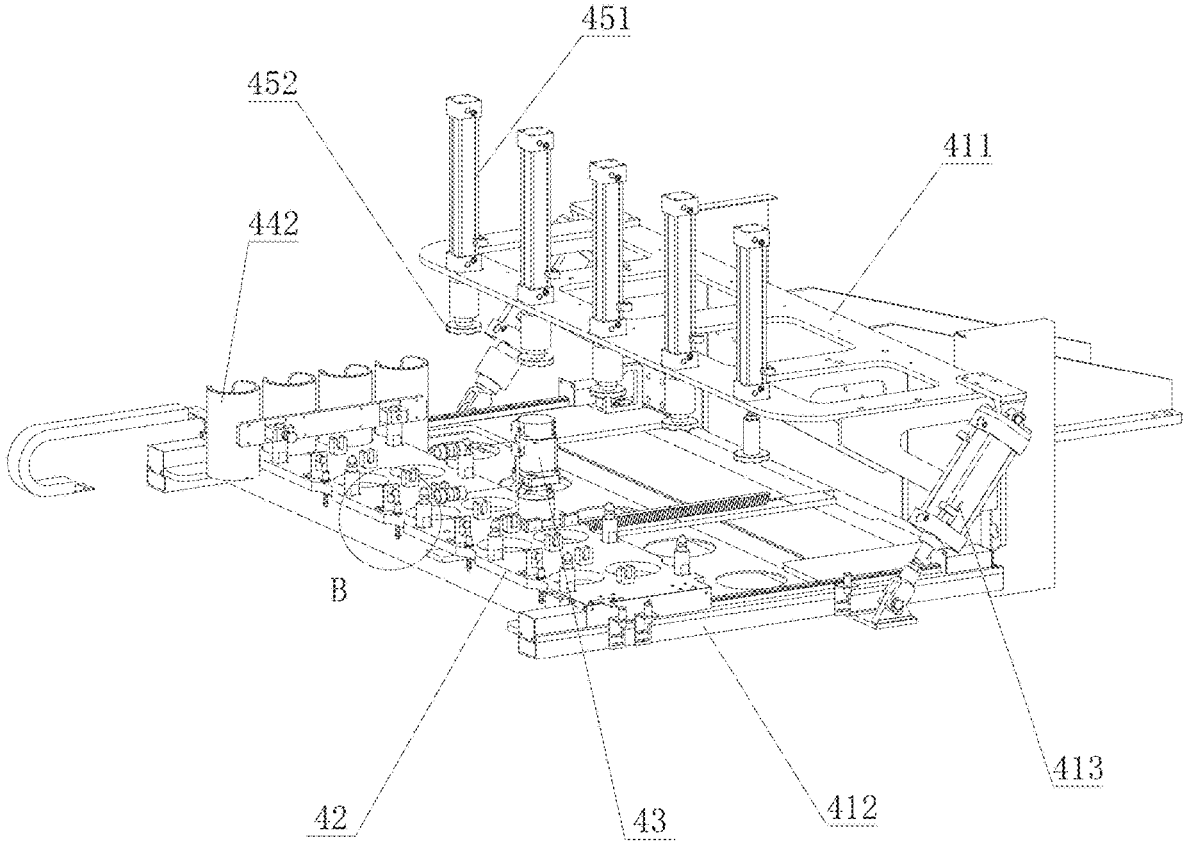
FIG. 8 is a three-dimensional structural view (from another perspective) of the feed mechanism of the invention.
Figure 9:
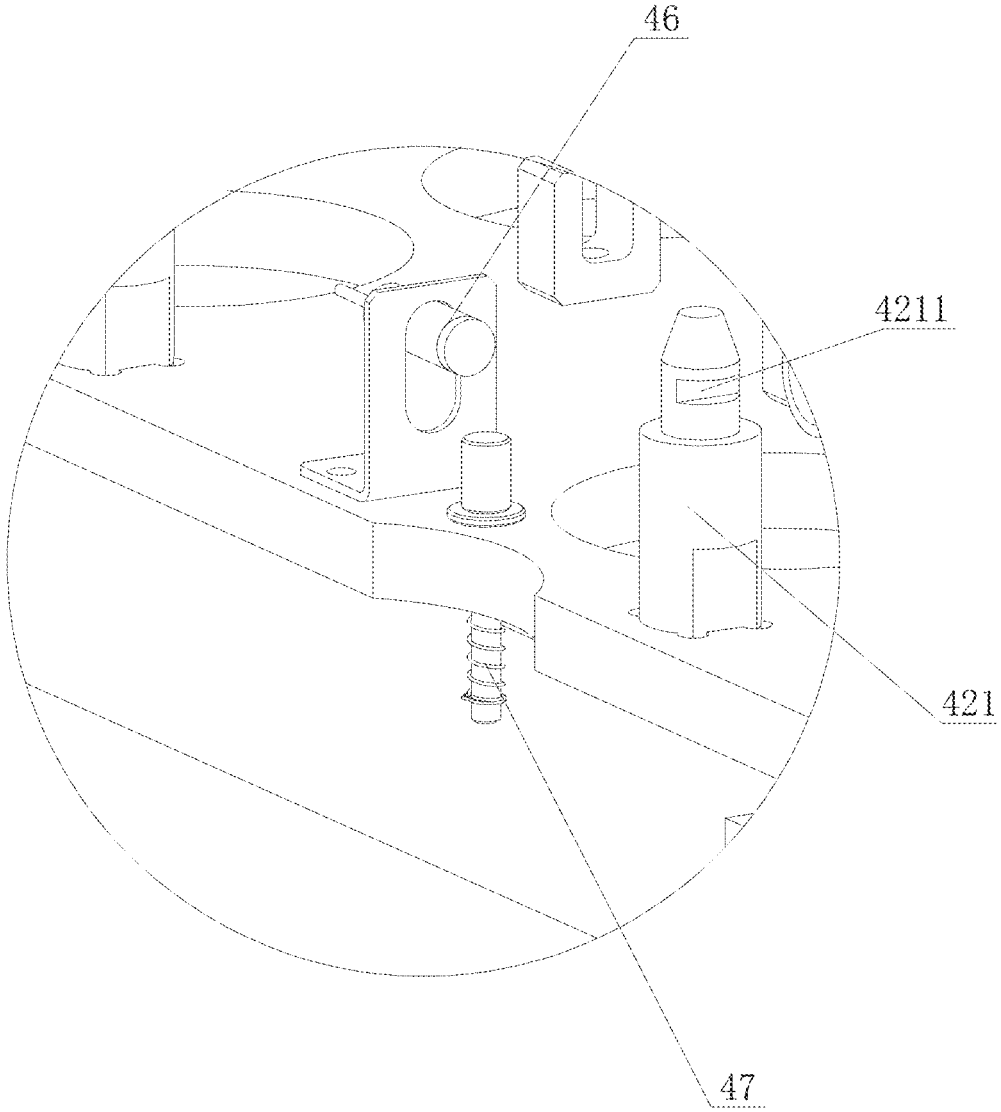
FIG. 9 is an enlarged structural view of part B in FIG. 8.
Figure 10:
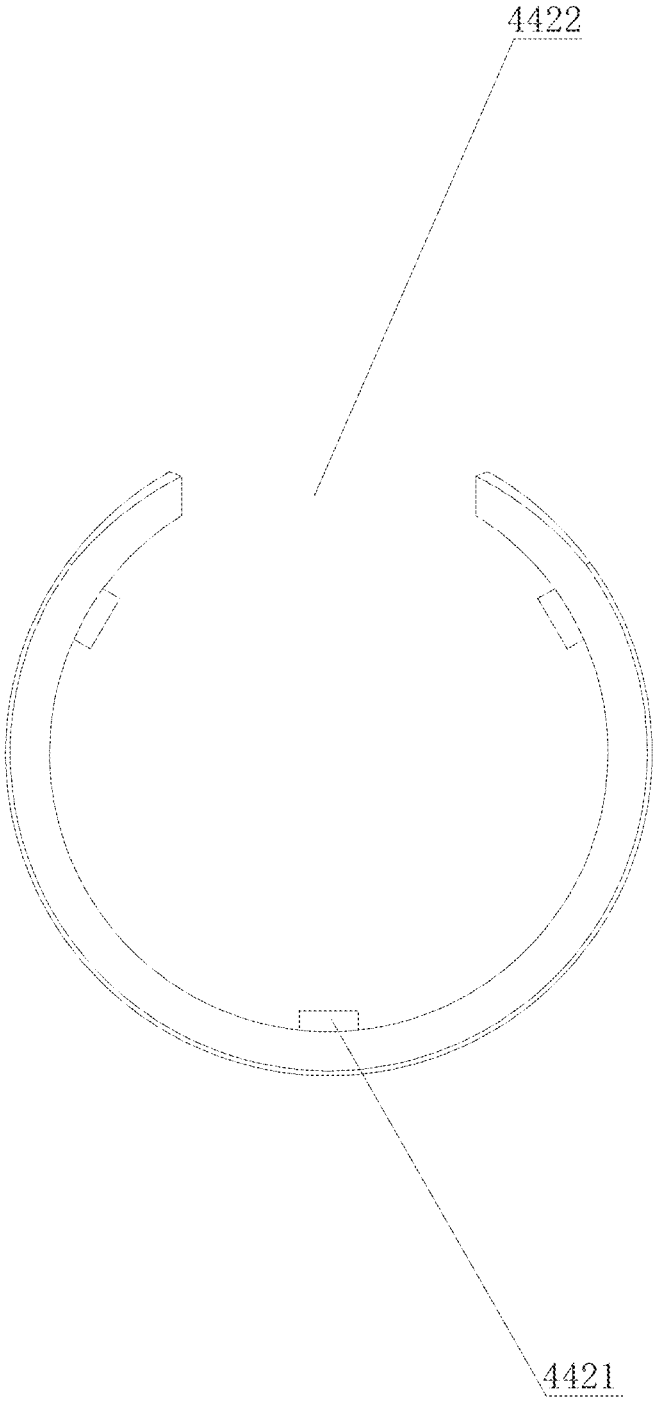
FIG. 10 is a structural view of a storage cylinder of the invention.
Figure 11:
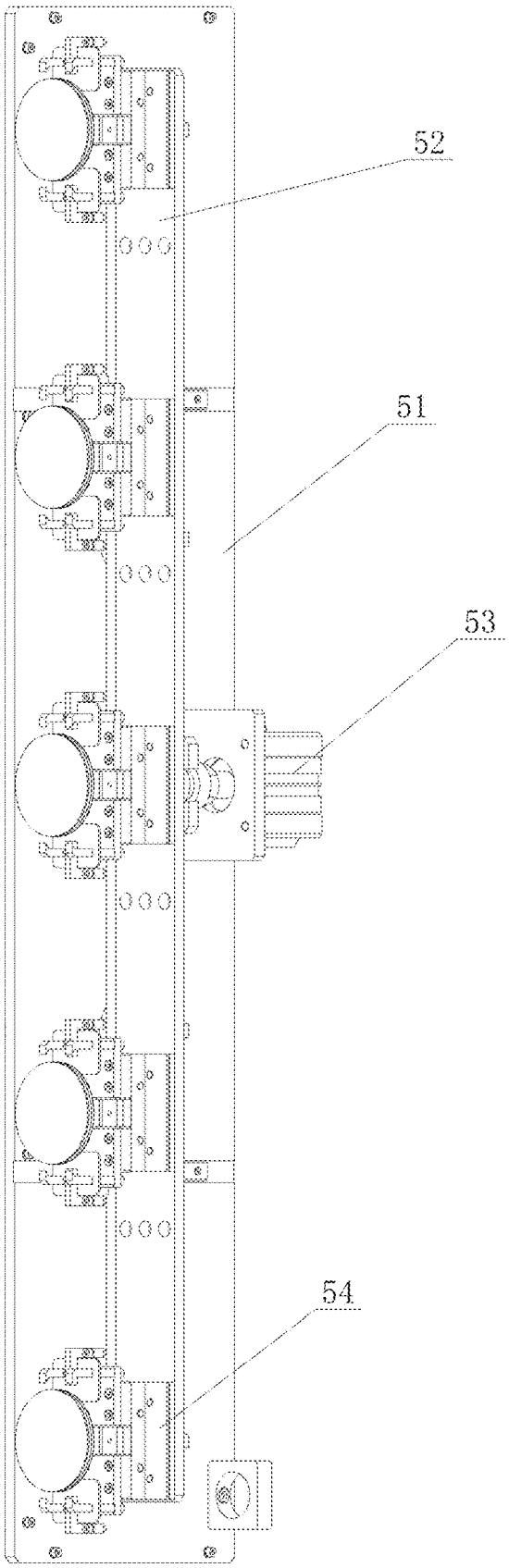
FIG. 11 is a front structural view of a discharge mechanism of the invention.
Figure 12:
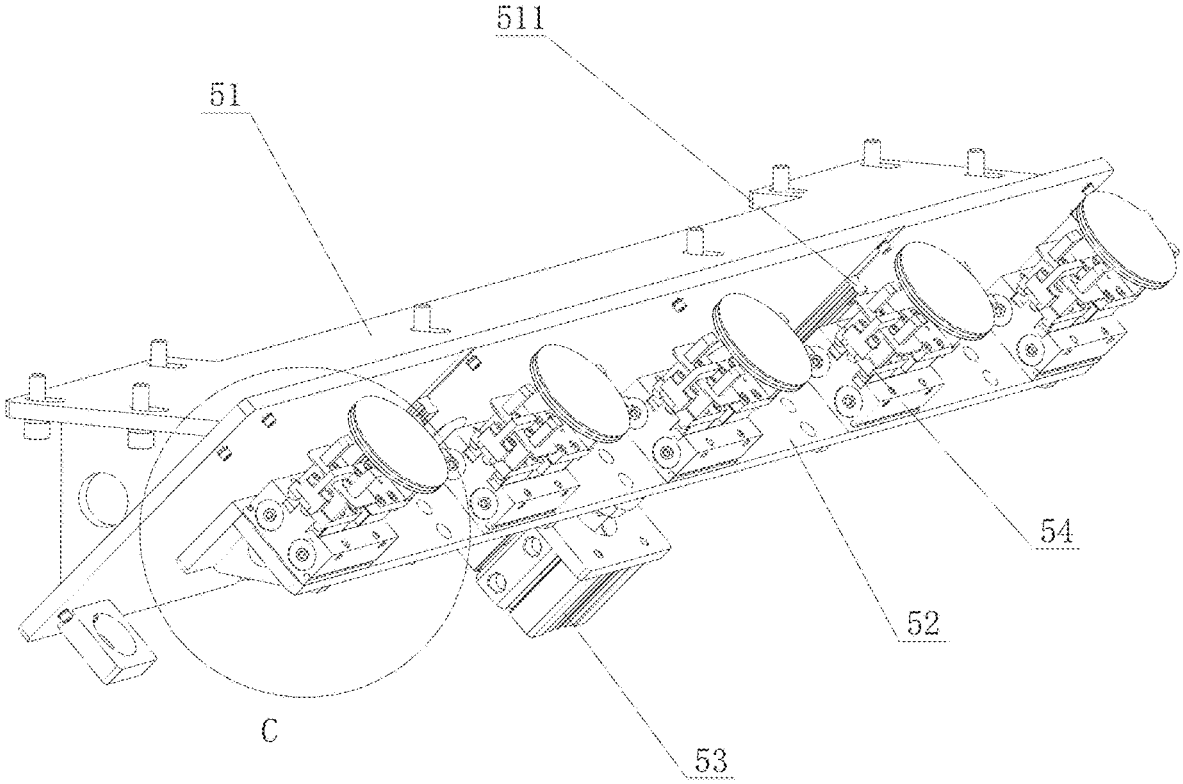
FIG. 12 is a three-dimensional structural view of the discharge mechanism of the invention.
Figure 13:
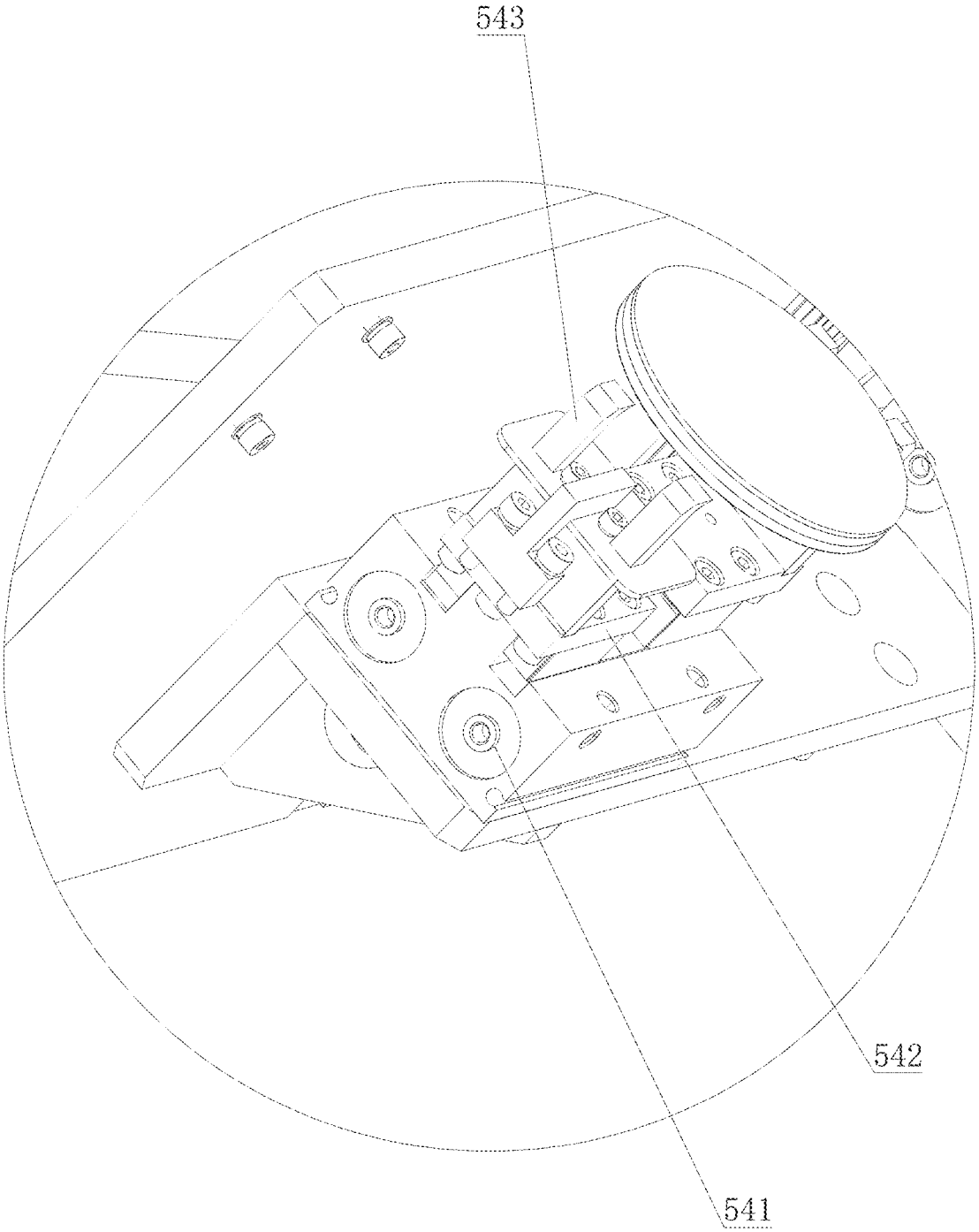
FIG. 13 is an enlarged structural view of part C in FIG. 12.
Figure 14:
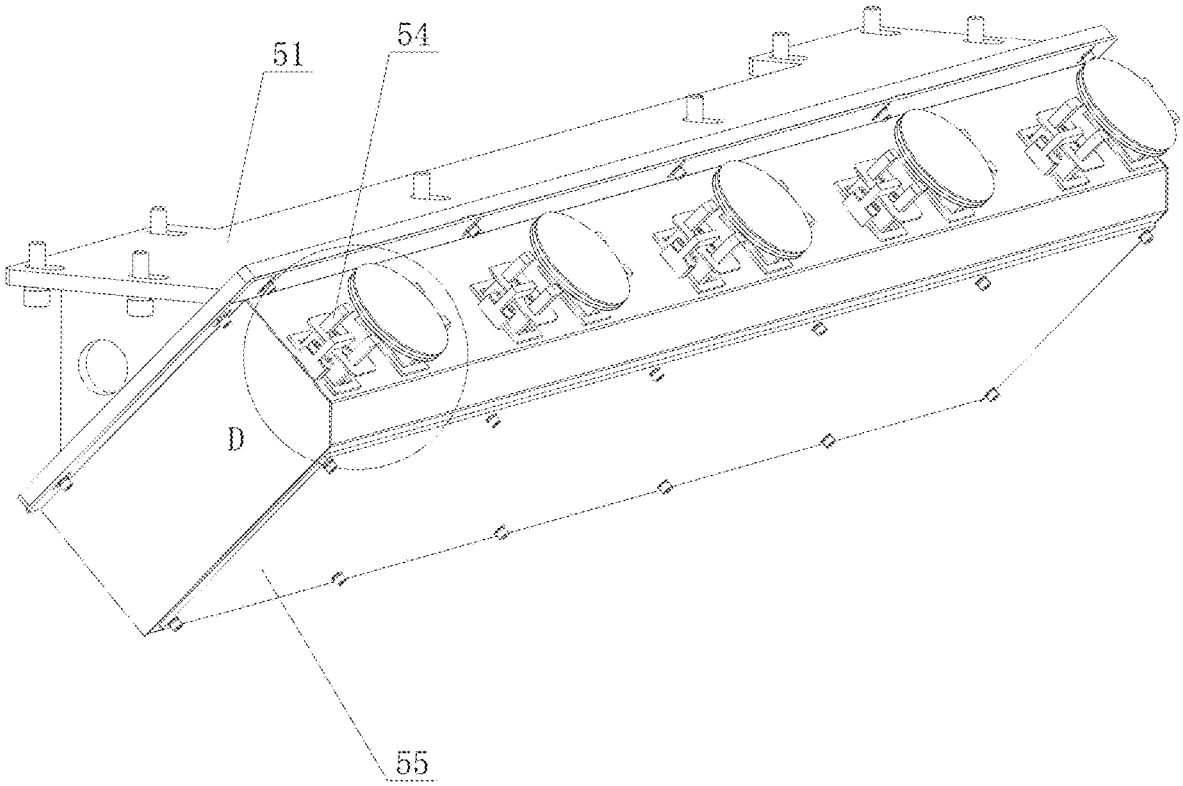
FIG. 14 is a three-dimensional structural view of the discharge mechanism of the invention (with a shield).
Figure 15:
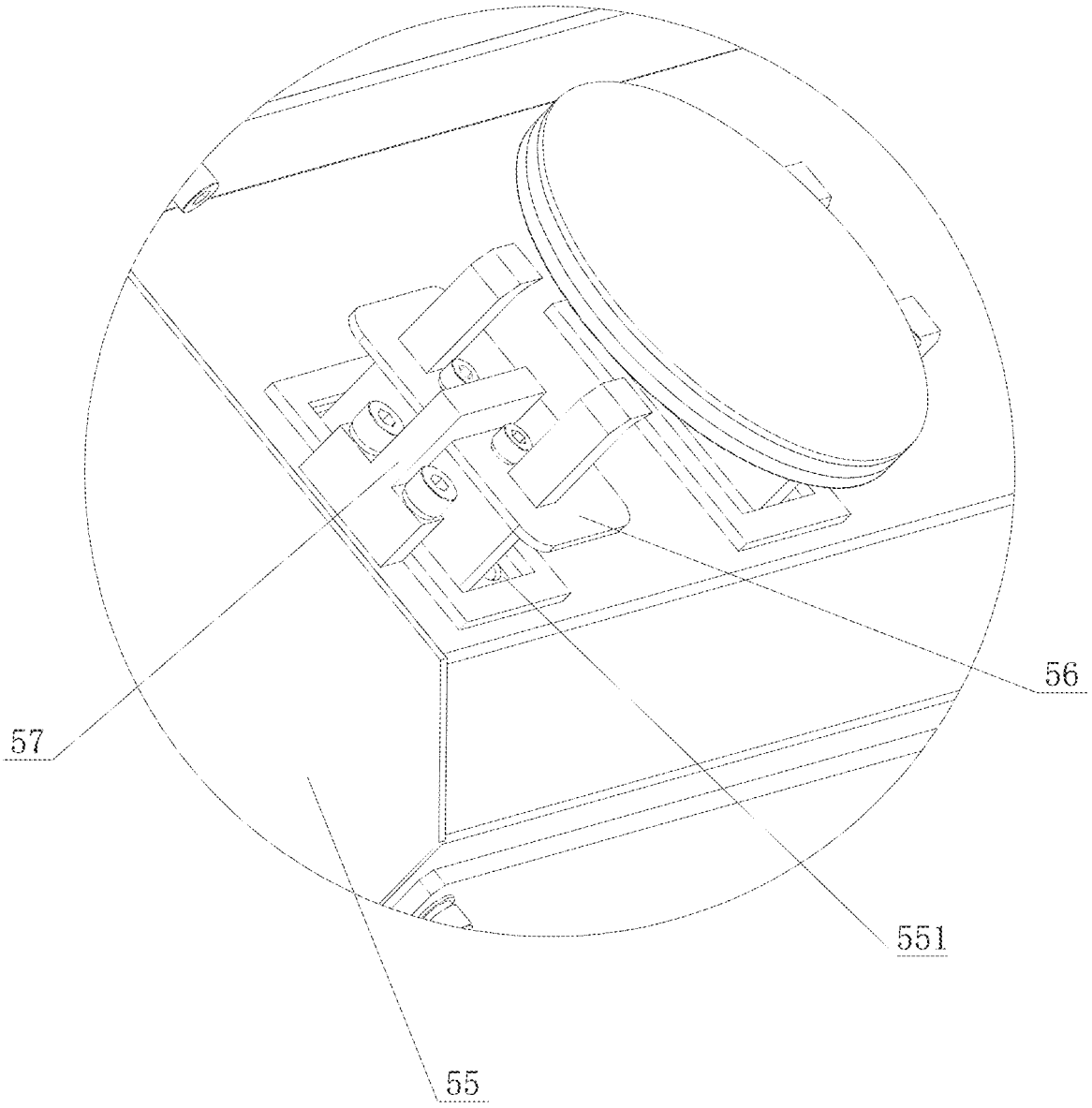
FIG. 15 is an enlarged structural view of part D in FIG. 14.

As shown in FIG. 1 to FIG. 15, one embodiment of the invention provides a polishing machine with an automatic feed and discharge function, including a machine frame 1, a clamping mechanism 2, a polishing shaft 3, a feed mechanism 4 and a discharge mechanism 5, wherein the clamping mechanism 2, the discharge mechanism 5, the polishing shaft 3 and the feed mechanism 4 are mounted on the machine frame 1 from bottom to top; multiple polishing heads 6 are mounted on the polishing shaft 3 in a circumferential direction and an axial direction; and the feed mechanism 4 includes a feed frame 41, a sliding platform 42, a sliding drive member 43, multiple columns of storage mechanisms 44 for storing the polishing pads, and multiple columns of push mechanisms 45, the number of the columns of the storage mechanisms 44 matches the number of the columns of the push mechanisms 45, the feed frame 41 is mounted on the machine frame 1, the sliding platform 42 is slidably arranged on the feed frame 41, the multiple rows of the storage mechanisms 44 are mounted on the sliding platform 42, the multiple rows of the push mechanisms 45 are mounted on the feed frame 41 and are located above the storage mechanisms 44, the sliding drive member 43 is mounted on the sliding platform 42 and drives the sliding platform 42 to drive the storage mechanisms 44 to correspond to the polishing heads below and the pushing mechanisms 45 above in position, and the push mechanisms 45 push the polishing pads in the storage mechanisms 44 to the polishing heads 6 to be bonded onto the polishing heads 6. When the polishing machine with automatic feed and discharge function is used, the polishing pads are placed in the storage mechanisms 44 first; when the polishing pads on the polishing heads 6 need to be replaced, the polishing machine is stopped, and the discharge mechanism 5 is started to grab the polishing pads on the polishing heads 6, so that automatic discharge of the polishing pads is realized; then, the sliding drive member 43 is started to drive the sliding platform 42 to drive the storage mechanisms 44 to correspond to the polishing heads 6 below and the push mechanisms 45 above in position, then the push mechanisms 45 are started to push the polishing pads in the storage mechanisms 44 to the polishing heads 6 to be bonded onto the polishing heads 6, so that automatic feed of the polishing pads is completed; and components are clamped on the clamping mechanism 2 and are then polished by the polishing heads 6 on the polishing shaft 3. Compared with traditional structures, the polishing machine can load and discharge polishing pads automatically through the feed mechanism 4 and the discharge mechanism 5, has a simple structure, saves time and labor, and improves the production capacity and efficiency; in addition, failures to load or discharge polishing pads caused by manual operation are avoided, and the pad loading and discharging accuracy is guaranteed.

In this embodiment, the sliding drive member 43 is a servo motor.

In this embodiment, each storage mechanism 44 includes a mounting frame 441 and multiple storage cylinders 442 for storing the polishing pads, wherein each column of the storage cylinders 442 are fixedly arranged on the mounting frame 441 in multiple rows, and the mounting frame 441 is mounted on the sliding platform 42. In this structure, the storage cylinders 442 are arranged in an array, thus having the advantages of being high in storage capacity and easy to arrange and switch.

In this embodiment, the storage cylinders 442 are hollow vertically, and an elastic clip 4421 is disposed on an inner edge of the bottom of each of the storage cylinders 442. The elastic clips 4421 are used to retain the polishing pads when the polishing pads are stored, so that the polishing pads are prevented from falling off. When the polishing pads are loaded, the elastic clips 4421 can be pushed open under the effect of the push mechanisms 45 to release the polishing pads, so that the polishing pads can be loaded smoothly; and the structure is simple and ingenious.

In this embodiment, openings 4422 for placing the polishing pads in the storage cylinders 442 are formed in sides, away from the mounting frame 441, of the storage cylinders 442. The openings 4422 provide an operation space, so that the polishing pads can be placed the storage cylinders 442 to be stored more easily.

In this embodiment, the mounting frame 441 includes a fixing plate 4411 and insertion lugs 4412, insertion poles 421 are disposed on the sliding platform 42, each column of the storage cylinders 442 are fixedly arranged on the fixing plate 4411, the insertion lugs 4412 are fixedly arranged on the fixing plate 4411, and the insertion poles 421 are inserted into the insertion lugs 4412. In this structure, the fixing plate 4411 is used for fixing the same column of storage cylinders 442, and the storage cylinders 442 can be mounted and replaced rapidly through the cooperation of the insertion lugs 4412 and the insertion poles 421, so that the efficiency is further improved.

In this embodiment, lock bolts 4413 are disposed on lateral portions of the insertion lugs 4412, slots 4211 are formed in the insertion poles 421, and the lock bolts 4413 are matched with the slots 4211 to realize locking. The insertion lugs 4412 and the insertion poles 421 are locked together through the cooperation of the lock bolts 4413 and the slots 4211, so that the stability and reliability during pad loading process are guaranteed.

In this embodiment, the sliding platform 42 is provided with feed sensors 46 for detecting whether polishing pads exist on the polishing heads 6, the sliding platform 42 is further provided with spring bolts 47, and when the spring bolts 47 are lifted by the polishing pads on the polishing heads 6, the feed sensors 46 sense the spring bolts 47. When the polishing pads are replaced, if the feed sensors 46 sense the spring bolts 47, it indicates that the spring bolts 47 are lifted by the polishing pads on the polishing heads 6, that is, the polishing pads are discharged from the polishing heads 6, and the push mechanisms 45 will not work at this time. The push mechanisms 45 work to load the polishing pads only when the feed sensors 46 do not sense the spring bolts 47, namely when the polishing pads are discharged from the polishing heads 6, so that failures to load pads caused by manual operation are further avoided, and the pad loading accuracy is guaranteed.

In this embodiment, the feed frame 41 includes a fixing frame 411, a turnable frame 412 and turning drive members 413, the fixing frame 411 is mounted on the machine frame 1, the turning drive members 413 are hinged to the fixing frame 411, the turnable frame 412 is hinged to the turning drive members 413, the sliding platform 42 is slidably arranged on the turnable frame 412, and the push mechanisms 45 are mounted on the fixing frame 411. In this structure, the turning drive members 413 can drive the turnable frame 412 to swing; when the storage cylinders 442 are mounted, the turnable frame 412 is driven to swing downwards, so that the operation position for mounting the storage cylinders 442 is lowered, and the storage cylinders 442 can be mounted easily; and the operation space between the turnable frame 412 and the fixing frame 411 is expanded, and the problem that the storage cylinders 442 of the polishing machine are mounted in a narrow space is solved.

In this embodiment, the turning drive members 413 are cylinders.

In this embodiment, the fixing frame 411 is slidably arranged on the machine frame 1, a lifting motor 7 connected to the fixing frame 411 is mounted on the machine frame 1, and when the lifting motor 7 drives the fixing frame 411 to a low position, gaps between the storage mechanisms 44 and the polishing heads 6 are equal to the thickness of one polishing pad. The gaps, equal to the thickness of one polishing pad, can be formed between the storage cylinders 442 and the polishing heads 6 through the lifting motor 7, so that the push mechanisms 45 can push down only one polishing pad every time; and the structure is simple and ingenious.

In this embodiment, the turnable frame 412 is provided with limit sensors 48 located at two ends and an origin sensor 49 located between the limit sensors 48, in a travel direction of the sliding platform 42. The travel distance and accuracy of the sliding platform 42 are guaranteed through the limit sensors 48 and the origin sensor 49.

In this embodiment, each push mechanism 45 includes a push cylinder 451 fixedly arranged on the feed frame 41 and a push head 452 connected to the push cylinder 451. In this structure, the push cylinder 451 drives the push head 452 to push the polishing pads in the storage cylinders 442 to the corresponding polishing heads 6 to be bonded onto the polishing heads 6; and the structure is simple and reliable.

In this embodiment, the discharge mechanism 5 includes a discharge frame 51, a movable frame 52, a moving drive member 53 and multiple columns of grabbing mechanisms 54 for grabbing the polishing pads on the polishing heads 6, the discharge frame 51 is mounted on the machine frame 1, the movable frame 52 is slidably arranged on the discharge frame 51, the multiple columns of grabbing mechanisms 54 are mounted on the movable frame 52, and the moving drive member 53 is mounted on the discharge frame 51 and drives the movable frame 52 to drive the grabbing mechanisms 54 to move to positions corresponding to the corresponding polishing heads 6. When the polishing pads on the polishing heads 6 need to be replaced, the polishing machine is stopped, the moving drive member 53 is started to drive the grabbing mechanisms 54 to move to positions corresponding to the corresponding polishing heads 6, and then the grabbing mechanisms 54 work to grab the polishing pads on the polishing heads 6, so that automatic discharge of the polishing pads is realized; and components are clamped on the clamping mechanism 2 and are then polished by the polishing heads 6 on the polishing shaft 3. Compared with traditional structures, the discharge mechanism can discharge the polishing pads automatically, has a simple structure, saves time and labor, and improves the production capacity and efficiency; in addition, failures to discharge the polishing pads caused by manual operation are avoided, and the pad discharging accuracy is guaranteed.

In this embodiment, the moving drive member 53 is a cylinder.

In this embodiment, each grabbing mechanism 54 includes a pneumatic seat 541, a pair of sliding seats 542 and clamping jaws 543 mounted on the sliding seats 542, wherein the pneumatic seat 541 is fixedly arranged on the movable frame 52 and is connected to an external gas, the pair of sliding seats 542 is slidably arranged on the pneumatic seat 541 and drives the clamping jaws 543 to clamp and grab the polishing pads on the polishing heads 6. In this structure, the gas guided in the pneumatic seat drives the clamping jaws 543 to close up along the sliding seats 542 to clamp and grab the polishing pads; and when the clamping jaws 543 are opened along the sliding seat 542, the polishing pads are released and fall off, so that grabbing-type automatic discharge is realized.

In this embodiment, a shield 55 for covering the movable frame 52, the moving drive member 53 and the grabbing mechanisms 54 is disposed on the discharge frame 51. The shield 55 protects the movable frame 52, the moving drive member 53 and the grabbing mechanisms 54.

In this embodiment, the shield 55 is formed with recess holes 551 allowing the clamping jaws 543 to stretch out. The clamping jaws 543 can stretch out via the recess holes 551 to clamp and grab.

In this embodiment, water baffles 56 for sealing the recess holes 551 are mounted on the shield 55, and the clamping jaws 543 penetrate through the water baffles 56. The water baffles 56 seal the recess holes 551, so that cooling water and dirt in the outside are prevented from entering the shield 55 via the recess holes 551.

In this embodiment, stoppers 57 for driving polishing pads to fall off from the clamping jaws 543 are also mounted on the shield 55. When the moving drive member 53 drives the clamping jaws 543 to retreat, the polishing pads will touch the stoppers 57, so that the polishing pads will be driven to fall off from the clamping jaws 543; and the structure is simple and ingenious.

In this embodiment, slideways 511 are disposed on the discharge frame 51, and the movable frames 52 are slidably arranged on the slideways 511. The movable frames 52 can move smoothly on the slideways 511.

Although the invention has been disclosed above with reference to preferred embodiments, these preferred embodiments are not used to limit the invention. Any skilled in the art can make many possible transformations and modifications to the technical solution of the invention according to the technical contents disclosed above without departing from the scope of the technical solution of the invention. Thus, any simple amendments or equivalent variations and modifications made to the above embodiments according to the technical essence of the invention without departing from the contents of the technical solution of the invention should also fall within the protection scope of the technical solution of the invention.

What is claimed is:

1. A polishing machine with automatic feed and discharge function, comprising a machine frame, a clamping mechanism, a polishing shaft, a feed mechanism and a discharge mechanism, wherein the clamping mechanism, the discharge mechanism, the polishing shaft, and the feed mechanism are mounted on the machine frame; multiple polishing heads are mounted on the polishing shaft in a circumferential direction and an axial direction; and the feed mechanism comprises a feed frame, a sliding platform, a sliding drive member, multiple columns of storage mechanisms for storing polishing pads, and multiple columns of push mechanisms, each column of the multiple columns of the storage mechanisms comprises a storage mechanism, each column of the multiple columns of push mechanisms comprises a push mechanism, the number of the columns of the storage mechanisms matches the number of the columns of the push mechanisms, the feed frame is mounted on the machine frame, the sliding platform is slidably arranged on the feed frame, each of the multiple columns of the storage mechanisms is mounted on the sliding platform, each of the multiple columns of the push mechanisms is mounted on the feed frame and is located above a respective storage mechanism of the storage mechanisms, the sliding drive member is mounted on the sliding platform and drives the sliding platform to move each of the storage mechanisms to a position corresponding to a respective polishing head of the polishing heads which is below the respective storage mechanism and a respective push mechanism of the push mechanisms which is above the respective storage mechanism, and each of the push mechanisms is configured to push a respective polishing pad of the polishing pads in the storage mechanisms to the respective polishing head of the polishing heads to bond the respective polishing pad onto the respective polishing head.

2. The polishing machine with automatic feed and discharge function according to claim 1, wherein each of the storage mechanisms comprises a mounting frame and multiple storage cylinders for storing the polishing pads, the storage cylinders in each of the columns of the multiple columns of the storage mechanisms are fixedly arranged on the mounting frame and are arranged in multiple rows, and the mounting frame of each of the storage mechanisms is mounted on the sliding platform.

3. The polishing machine with automatic feed and discharge function according to claim 2, wherein the storage cylinders are hollow vertically, an elastic clip is disposed on an inner edge of a bottom of each of the storage cylinders, and each of the storage cylinders has an opening for placing a respective polishing pad of the polishing pads into a respective storage cylinder of the storage cylinders, the opening is formed in a side of the respective storage cylinder away from the mounting frame.

4. The polishing machine with automatic feed and discharge function according to claim 3, wherein each of the mounting frames comprises a fixing plate and insertion lugs, the sliding platform is provided with insertion poles, each of the storage cylinders is fixedly arranged on the fixing plate, the insertion lugs are fixedly arranged on the fixing plate, and the insertion poles are inserted into the insertion lugs.

5. The polishing machine with automatic feed and discharge function according to claim 4, wherein lock bolts are disposed on lateral portions of the insertion lugs, slots are formed in the insertion poles, and the lock bolts are matched with the slots for locking.

6. The polishing machine with automatic feed and discharge function according to claim 1, wherein the sliding platform is provided with feed sensors, each of the feed sensors is for detecting whether a respective polishing pad of the polishing pads exist on a respective polishing head of the polishing heads, the sliding platform is also provided with spring bolts, and when each of the spring bolts is lifted by the respective polishing pad on the respective polishing head, a respective feed sensor of the feed sensors senses the respective spring bolt.

7. The polishing machine with automatic feed and discharge function according to claim 1, wherein the feed frame comprises a fixing frame, a turnable frame and turning drive members, the fixing frame is mounted on the machine frame, each of the turning drive members is hinged to the fixing frame, the turnable frame is hinged to each of the turning drive members, the sliding platform is slidably arranged on the turnable frame, and each of the push mechanisms is mounted on the fixing frame.

8. The polishing machine with automatic feed and discharge function according to claim 7, wherein the fixing frame is slidably arranged on the machine frame, a lifting motor connected to the fixing frame is mounted on the machine frame, and when the lifting motor drives the fixing frame to a low position, each of gaps between the storage mechanisms and the polishing heads is equal to a thickness of each of the polishing pads.

9. The polishing machine with automatic feed and discharge function according to claim 8, wherein the turnable frame is provided with limit sensors located at two ends and an origin sensor located between the limit sensors, in a travel direction of the sliding platform.

10. The polishing machine with automatic feed and discharge function according to claim 1, wherein each of the push mechanisms comprises a push cylinder fixedly arranged on the feed frame and a push head connected to the push cylinder.

11. The polishing machine with automatic feed and discharge function according to claim 1, wherein the discharge mechanism comprises a discharge frame, a movable frame, a moving drive member and multiple columns of grabbing mechanisms, each column of the multiple columns of the grabbing mechanisms comprises a grabbing mechanism, each of the grabbing mechanisms is for grabbing the respective polishing pad on the respective polishing head, the discharge frame is mounted on the machine frame, the movable frame is slidably arranged on the discharge frame, each of the grabbing mechanisms is mounted on the movable frame, and the moving drive member is mounted on the discharge frame and drives the movable frame to drive each of the grabbing mechanisms to move to a position corresponding to the respective polishing head.

12. The polishing machine with automatic feed and discharge function according to claim 11, wherein each of the grabbing mechanisms comprises a pneumatic seat, a pair of sliding seats and clamping jaws mounted on the sliding seats, the pneumatic seat is fixedly arranged on the movable frame and is connected to an external gas, the pair of sliding seats is slidably arranged on the pneumatic seat and drives the clamping jaws to clamp and grab each of the polishing pads which is on the respective polishing head.

13. The polishing machine with automatic feed and discharge function according to claim 12, wherein a shield for covering the movable frame, the moving drive member and each of the grabbing mechanisms is disposed on the discharge frame.

14. The polishing machine with automatic feed and discharge function according to claim 13, wherein the shield is formed with recess holes, each of the recess holes allows a respective clamping jaw of the clamping jaws to stretch out.

15. The polishing machine with automatic feed and discharge function according to claim 14, wherein water baffles are mounted on the shield, each of the water baffles is for sealing a respective recess hole of the recess holes, and each of the clamping jaws penetrates through a respective water baffle of the water baffles.

16. The polishing machine with automatic feed and discharge function according to claim 15, wherein stoppers are also mounted on the shield, each of the stoppers is for driving the respective polishing pad to fall off from the respective clamping jaw.

17. The polishing machine with automatic feed and discharge function according to claim 12, wherein a slideway is disposed on the discharge frame, and the movable frame is slidably arranged on the slideway.

* * * * *